US006247280B1

(12) United States Patent
Grinshpun et al.

(10) Patent No.: US 6,247,280 B1
(45) Date of Patent: Jun. 19, 2001

(54) INSULATED WALL CONSTRUCTION AND FORMS AND METHOD FOR MAKING SAME

(75) Inventors: Vyacheslav S. Grinshpun; W. Scott Young, both of Midland, MI (US)

(73) Assignee: The Dow Chemical Company, Midland, MI (US)

( * ) Notice: Subject to any disclaimer, the term of this patent is extended or adjusted under 35 U.S.C. 154(b) by 0 days.

(21) Appl. No.: 09/551,684

(22) Filed: Apr. 18, 2000

Related U.S. Application Data

(60) Provisional application No. 60/130,788, filed on Apr. 23, 1999.

(51) Int. Cl.[7] ..... E04C 2/04

(52) U.S. Cl. ..... 52/309.12; 52/426; 52/439

(58) Field of Search ..... 52/425, 426, 439, 52/309.1, 309.4, 309.12, 309.17, 421

(56) References Cited

U.S. PATENT DOCUMENTS

| | | | | |
|---|---|---|---|---|
| 1,035,206 | * | 8/1912 | Lewen | 52/426 X |
| 1,877,898 | * | 9/1932 | Kotrbaty | 52/439 X |
| 3,827,205 | * | 8/1974 | Barbera | 52/426 |
| 4,348,847 | | 9/1982 | Jukes et al. . | |
| 4,439,967 | * | 4/1984 | Dielenberg | 52/439 X |
| 4,706,429 | * | 11/1987 | Young | 52/426 X |
| 4,884,382 | * | 12/1989 | Horobin | 52/426 |
| 4,889,310 | * | 12/1989 | Boeshart | 52/426 X |
| 4,967,528 | * | 11/1990 | Doran | 52/309.12 |
| 5,216,863 | * | 6/1993 | Nessa et al. | 52/439 |
| 5,311,718 | * | 5/1994 | Trousilek | 52/439 X |
| 5,706,620 | | 1/1998 | De Zen . | |
| 5,729,944 | | 3/1998 | De Zen . | |
| 5,740,648 | * | 4/1998 | Piccone | 52/426 |
| 5,809,728 | | 9/1998 | Tremeling . | |

FOREIGN PATENT DOCUMENTS

| | | | | |
|---|---|---|---|---|
| 1070361 | * | 12/1959 | (DE) | 52/439 |
| 23 49 601 | | 6/1978 | (DE) . | |
| 1243173 | | 8/1971 | (GB) . | |
| 94/18405 | | 8/1994 | (WO) . | |
| 94/21867 | | 9/1994 | (WO) . | |
| 95/33106 | | 12/1995 | (WO) . | |
| 97/32092 | | 9/1997 | (WO) . | |
| 97/32095 | | 9/1997 | (WO) . | |

* cited by examiner

*Primary Examiner*—Richard Chilcot

(57) ABSTRACT

A form assemblage for making concrete and other building walls is disclosed. The form assemblage includes interlocking interior and exterior wall panels that are connected at a predetermined spacing with panel connectors that interlock with the interior wall panels and the exterior wall panels. The panel connectors have means for holding insulating foam panels at a position intermediate to the interior and exterior wall panels. Cavities between the insulating foam panels and the exterior and/or interior wall panels can be filled with concrete or other load-bearing materials. In certain aspects, the form assemblage can be used as a wall structure without the use of the load-bearing material.

18 Claims, 5 Drawing Sheets

INSULATED WALL CONSTRUCTION AND FORMS AND METHOD FOR MAKING SAME

This application claims benefit to U.S. provisional application Ser. No. 60/130,788, filed Apr. 23, 1999.

STATEMENT REGARDING FEDERALLY SPONSORED RESEARCH OR DEVELOPMENT

The research and development leading to the invention described and claimed herein was not federally sponsored.

BACKGROUND OF THE INVENTION

This invention relates to a method for making walls for buildings, particularly walls of concrete or similar material made using forms to shape the wall.

A common method of building walls for houses and other buildings is to prepare forms outlining the shape of the wall, pour concrete or other curable material into the form, and then allow the material to harden to complete the wall. The forms are often plywood, particle board or other wood product, steel or aluminum and are usually removed when the wall is completed. Often, the forms cannot be reused and must be disposed of or consumed in some other, lower value application. In addition, assembling and dissembling the forms is labor-intensive and time-consuming.

A wall made by the foregoing method often must be insulated. This is particularly true if the wall is abovegrade, but is also true in many areas for below-grade construction. An example of the latter is a home basement that may be used as habitable space, or a basement in a home or office building in which thermal insulation not only provides comfort but also helps reduce structural damage that is created by temperature cycling. In the method described above, insulation is added as a separate construction step. In addition, the insulation can be installed only at the external surfaces of the wall. A common method of doing this is to construct a series of studs on the inside of the wall, place insulation in the space created between the studs, and then cover the studs with a material such as drywall or plaster to form an inside wall surface.

For aesthetic and comfort reasons, it is often desirable to cover the exposed surfaces of the wall. When the wall is made in the manner described above, this is accomplished in subsequent operations. Drywalling or plastering, as described in the previous paragraph, are examples of this. In the case of an exterior wall, a facade such as brick, siding, stucco or the like is often attached.

It has been proposed to build concrete walls using plastic forms. Among such proposals is that described in U.S. Pat. Nos. 5,706,620, 5,729,944 and WO publication nos. 97/32092, 97/32095, 94/18405, 94/21867 and 95/33106, all to De Zen. De Zen describes a wall construction based on interlocking, prefabricated plastic sectional forms of roughly rectangular cross-section. A series of these forms are connected to make a form for a wall, and then filled with concrete to complete the wall. The forms may be adapted so that they contain a layer of insulating foam on the interior or exterior surface, as shown for example in WO publication nos. 97/32092 and 97/32095. Because of the design of the forms, the insulating foam is generally restricted to a pour-in-place type, which tends to undergo dimensional changes as it ages. As a result of these dimensional changes, the integrity of the insulating layer is sometimes lost. Even more significantly, the insulating layer often distorts the plastic form itself. This distortion can interfere with the ability of adjacent forms to interlock easily. Yet another problem is that the forms are often bulky because they have rectangular cross-sections.

It would be desirable to provide an inexpensive, easily assembled form for making walls of concrete and other loadbearing materials. Preferably, such a form is easily adaptable to a variety of wall sizes and shapes and allows for the easy installation of services and openings. It would further be desirable to provide a method for making a wall in which the wall could be built and insulated in a single step, and preferably in which aesthetically and functionally pleasing interior and/or exterior surfaces could be provided as well.

SUMMARY OF THE INVENTION

Figure 1:
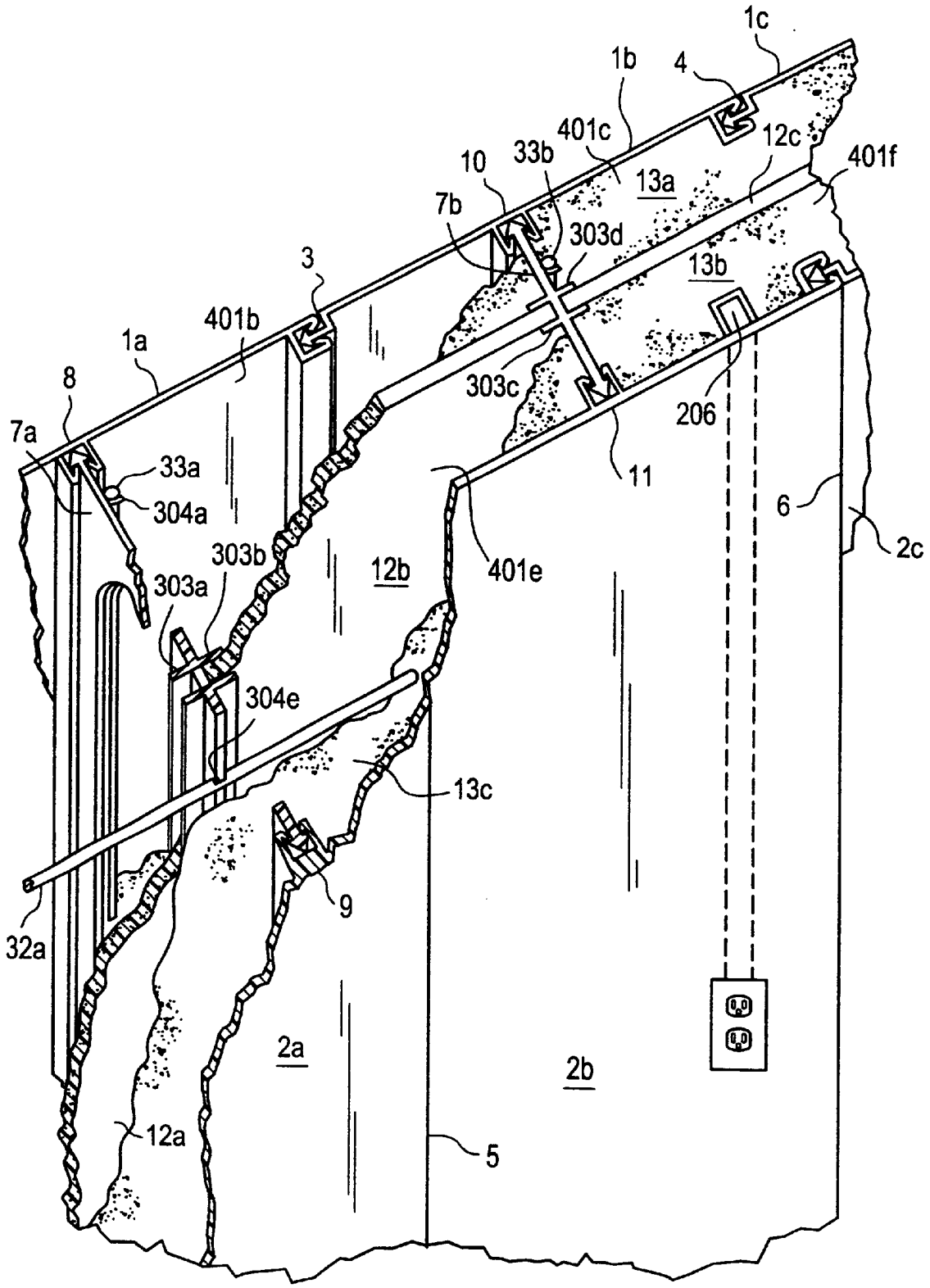
FIG. 1 is an isometric partial sectional view of one aspect of the invention.

In a first aspect, this invention is a wall construction that comprises a form assemblage having cavities that are filled with a load-bearing material. The form assemblage comprises (1) an interior wall surface comprising a plurality of interlocked interior wall panels, each panel having a first interlocking means on at least one panel edge and a second interlocking means on at least one panel edge, the first and second interlocking means being on opposing panel edges, the first interlocking means of one interior wall panel interlocking with the second interlocking means of an adjacent interior wall panel, said interior wall panels having at least one first panel connector interlocking means located on an internal surface thereof;

(2) an exterior wall surface spaced apart from said interior wall surface, said exterior wall surface comprising a plurality of interlocked exterior wall panels, each panel having a third interlocking means on at least one panel edge and a fourth interlocking means on at least one panel edge, the third and fourth interlocking means being on opposing panel edges, the first interlocking means of one exterior wall panel interlocking with the second interlocking means of an adjacent exterior wall panel, said exterior wall panels having at least one second panel connector interlocking means located on an internal surface thereof;

(3) a plurality of panel connectors, each panel connector having a body with interior wall panel interlocking means on one end interlocked with a first panel connector interlocking means of an interior wall panel and exterior wall panel interlocking means on an opposing end interlocked with a second panel connector interlocking means of an exterior wall panel, wherein said panel connectors further contain at least one insulating foam panel holding means located on said body between said interior wall panel interlocking means and said exterior wall panel interlocking means, and (4) a plurality of insulating foam panels located between and substantially parallel to said interior wall surface and said exterior wall surface and between each consecutive pair of panel connectors, said insulating foam panels being held in position by said foam insulating panel holding means on said consecutive panel connectors.

The foam assemblage contains a plurality of cavities bound by an insulating foam panel, the consecutive panel connectors which hold said insulating foam panel in place, and at least one of said interior wall surface or exterior wall surface. The cavities are filled with a load-bearing material.

The wall construction of this aspect of the invention provides for simplified wall construction and structural advantages. Because the interior wall panels, exterior wall panels and panel connectors interlock, a form for the construction of a wall can be quickly and easily assembled. By varying the width and shape of the wall panels, walls can be easily constructed in most desired configurations. Similarly, the thickness of the wall is easily manipulated as desired by selecting wider or narrower panel connectors. Services such as plumbing, electrical, telephone and the like are easily installed. Openings such as for doors and windows are easily provided for.

In addition, building and insulating the wall can be performed in a single construction step. Because the insulating foam panels are built into the wall construction, it is usually not necessary to separately install additional thermal insulation after the wall is completed. The position of the insulating foam panels within the wall can be easily adjusted by modifying the panel connectors accordingly. This permits the builder to install the insulating foam panels at the place in the wall where they have the most benefit for the particular climate, soil and other conditions that exist where the wall construction is built. Further, the interior wall panels and exterior wall panels will ordinarily become permanently attached to the wall structure, and if desired will form the internal and external exposed surfaces of the completed wall. In preferred embodiments, these wall panels can be designed to provide aesthetic details such that it becomes unnecessary to cover the wall panels with a facade or other finishing in order to have an aesthetically acceptable surface. In particularly preferred embodiments, the interior wall panels become the final, exposed interior walls of the building, and additional interior finishing such as affixing drywall or the like can be avoided.

In a second aspect, this invention is a method for making a wall construction. In the method, a form assemblage is made as described in the first aspect. Then, the cavities in the form assemblage are filled with a pour-in-place load-bearing material.

A third aspect of this invention is the form assemblage described in the first aspect.

The form assemblage of the third aspect can be used with or without a load-bearing material to form a freestanding wall or a wall for a building. When used without a load-bearing material, the form assemblage is suitable by itself for making the walls and roofs of light structures such as garages, tool sheds, light storage buildings and the like. Of course, the form assemblage of this aspect can be filled with a loadbearing material as discussed with respect to the first aspect.

A fourth aspect of this invention is a wall panel comprising a sheet of thermoplastic or thermosetting structural foam having two opposing edges, one of said opposing edges having an interlocking means for interlocking with a reciprocal interlocking means of a second wall panel, the other opposing edge having a reciprocal interlocking means for interlocking with an interlocking means of a third wall panel, said wall panel having at least one panel connector interlocking means on one side.

A fifth aspect of this invention is a panel connector comprising an elongated body having opposing edges, wall panel interlocking means along said edges for interlocking with a wall panel, and insulating foam panel holding means located on either side of said body between said opposing edges.

DETAILED DESCRIPTION OF THE INVENTION

FIG. 1 illustrates a portion of a wall construction according to the invention. The wall construction includes a plurality of exterior wall panels 1*a*, 1*b* and 1*c* and interior wall panels 2*a*, 2*b* and 2*c*. Adjacent exterior wall panels 1*a* and 1*b* are connected by being interlocked at a connection point designated as 3 in the drawing. Exterior wall panels 1*b* and 1*c* are similarly connected at connection point 4. The adjacent interior wall panels 2*a*, 2*b* and 2*c* are connected in series at seams 5 and 6. Note that the terms "exterior" and "interior" are used herein as shorthand expressions for the opposing sides of the wall construction. It is not necessary that the wall construction be an outside wall of a building. The wall construction may be a freestanding wall, such as a boundary wall or retaining wall. Alternatively, it may be an inside wall in a building, such as for creating separate rooms. The wall construction does not have to be vertical. For example, the wall construction of this invention can be used as a floor, roof, ceiling or other horizontal or angled structural component.

Panel connectors 7*a* and 7*b* connect the interior and exterior wall panels. In the embodiment shown, panel connector 7*a* connects to wall panels 1*a* and 2*a* by being interlocked therewith at connection points 8 and 9, respectively. Similarly, panel connector 7*b* connects to wall panels 1*b* and 2*b* by being interlocked therewith at connection points 10 and 11.

Panel connectors 7*a* and 7*b* have insulating foam panel holding means 303*a*, 303*b*, 303*c* and 303*d* for holding insulating foam panels 12*a*, 12*b* and 12*c* into a fixed position between exterior wall surfaces defined by exterior wall panels 1*a*, 1*b* and 1*c* and interior wall surfaces defined by interior wall panels 2*a*, 2*b* and 2*c*. As shown, insulating foam panels 12*a*, 12*b* and 12*c* are positioned in a preferred manner between and separate from the exterior and interior wall surfaces. However, it is within the scope of the invention that the foam panels are held at any position intermediate to the exterior and interior wall surfaces, including adjacent to either the exterior or interior wall surfaces.

Figure 2A:
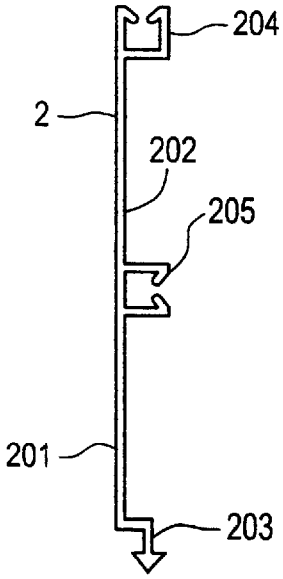
FIG. 2A is a top plan view of a wall panel of the invention.
Figure 2B:
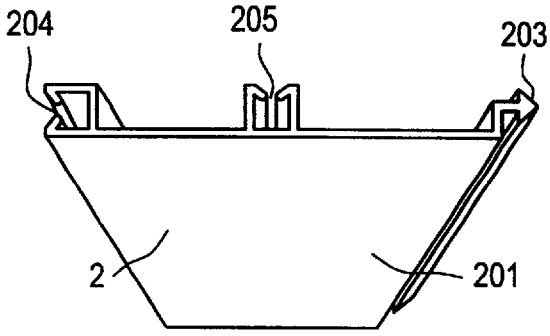
FIGS. 2B and 2C are top perspective views of a wall panel of the invention.
Figure 2C:
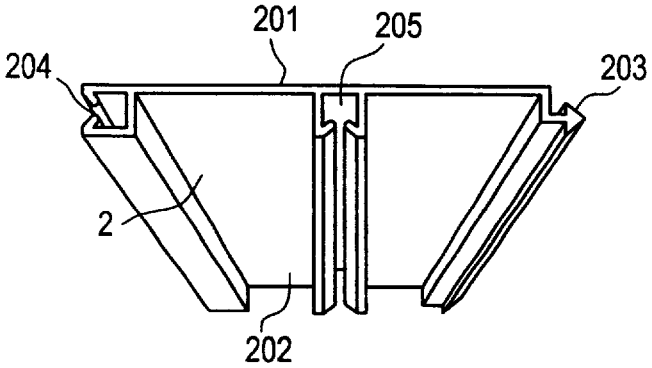

FIGS. 2A–2C further illustrate a wall panel for use in this invention. The wall panels used on the exterior and interior of the wall construction of the invention can and preferably do have the same general cross-sectional design, although they may differ in several respects as shown below. In FIGS. 2A–2C are shown a wall panel 2 having an external side 201 and an internal side 202. As used herein, "internal" means the side toward the center of the wall construction, and "external" means the side facing away from the center of the wall construction. Along one vertical edge of wall panel 2 is interlocking means 203, and reciprocal interlocking means 204 is located along the opposing vertical edge. Interlocking means 203 and 204 are designed to fit together so that when two adjacent wall panels are assembled to form the wall construction of the invention, the interlocking means 203 of one wall panel interlocks with reciprocal interlocking means 204 of the adjacent wall panel. As shown, interlocking means 203 is shaped as an arrow, and reciprocal interlocking means 204 is shaped as a receptacle for receiving and holding arrowshaped interlocking means 203. However, the shapes of the interlocking means 203 and 204 are not critical, provided that they correspond in structure so that adjacent wall panels can be snapped or slid into an interlocking relationship and the resulting interconnection is strong enough to hold together when the construction or load-bearing material is subsequently put in the wall. Thus, interlocking means 203 and 204 may take the form of a rib and groove, respectively, or may have any other interlocking shapes. It is also within the scope of the invention that interlocking means 203 and reciprocal interlocking means 204 be designed such that a separate piece can be snapped or slid over them to lock adjacent wall panels together.

In FIGS. 2A–2C, interlocking means 203 is offset toward internal side 202 of wall panel 2, so that a flat external surface having only a vertical seam is formed when wall panel 2 is interlocked with an adjacent wall panel, as shown in FIG. 1. For aesthetic reasons, it is generally preferred that interlocking means 203 and 204 are designed so that a flat external surface is provided, particularly on the interior side of the wall construction. It is particularly advantageous that the connection points between adjacent wall panels be visible from outside the wall only as a thin seam, the external surfaces of the wall panels together forming an uninterrupted flat surface, except for the seam.

Figure 5:
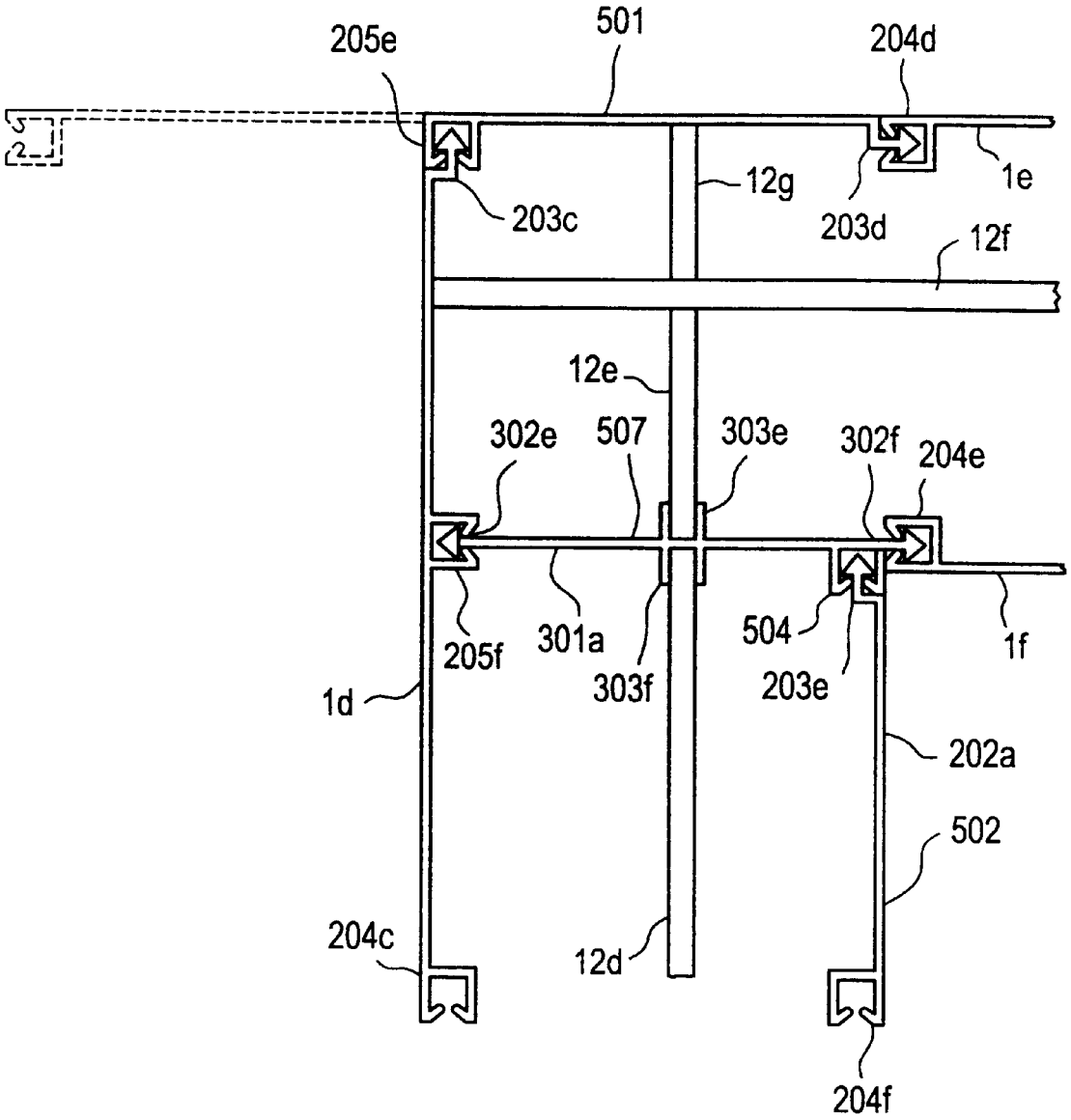
FIG. 5 is a top plan view of a corner portion of a form assemblage of the invention.

Wall panel 2 also has at least one internal panel connector interlocking means 205 for connecting wall panel 200 with a panel connector (e.g. connectors 7*a* and 7*b* shown in FIG. 1). Although not critical to the invention, panel connector interlocking means 205 preferably have approximately the same design and dimensions as either interlocking means 203 or reciprocal interlocking means 204. This permits panel connector interlocking means 205 to be used to connect wall panel 2 to another wall panel in a perpendicular relationship, thereby permitting a corner to be formed. This is illustrated in FIG. 5. As with interlocking means 203 and reciprocal interlocking means 204, panel connector interlocking means 205 may be of any convenient shape, provided that it interlocks with a panel connector to form a connection that is strong enough to hold together when the load-bearing material is subsequently put into the wall.

The various interlocking means 203, 204 and 205 preferably extend the full height of wall panel 2, as shown in FIGS. 2B–2C. This allows for maximum strength and stability of the connections of wall panel 2 to adjacent wall panels and to the panel connectors. In addition, having full-length interlocking means permits wall panel 2 to be easily prepared in an extrusion process, as discussed more fully hereinafter. However, it is within the scope of the invention to use interlocking means 203, 204 and 205 that do not extend for the entire height of wall panel 2. For example, the interlocking means 203 or 204 may run intermittently along the edges of wall panel 2, or may extend only partway along the vertical edges of wall panel 2.

The wall panel may also contain optional structures, such as a conduit for services such as data, phone, cable, electrical, plumbing, heating, ventilation, air conditioning and the like. A vertically oriented such conduit is shown at 206 in FIGS. 1 and 4. Preferably, the conduit 206 is not filled with the load-bearing material when the wall construction is built, so that the services running through conduit 206 can be accessed easily for repair, service or replacement. Although conduit 206 is shown in a vertical orientation, conduits may be oriented horizontally or even diagonally if desired.

Figure 3A:
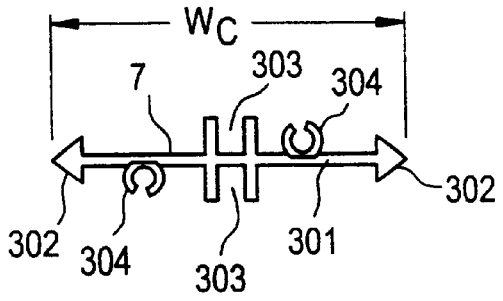
FIG. 3A is a top plan view of a panel connector for use in the invention.
Figure 3C:
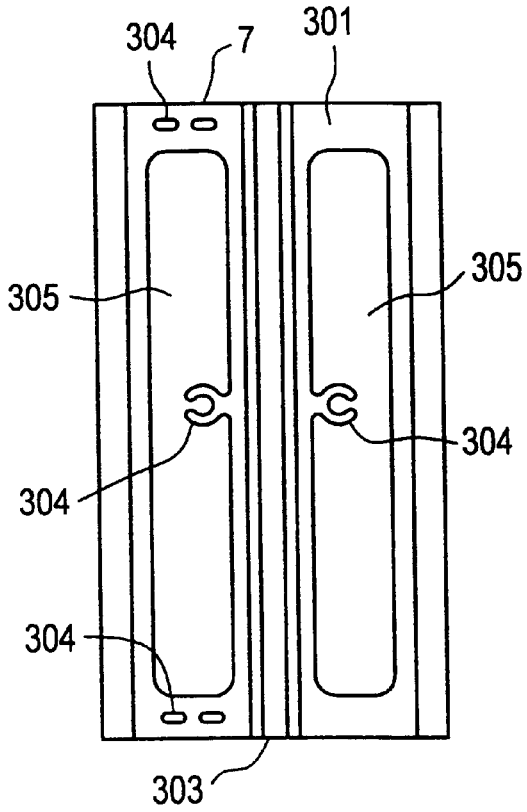
FIG. 3C is a perspective view from the top of a panel connector for use in the invention.
Figure 3B:
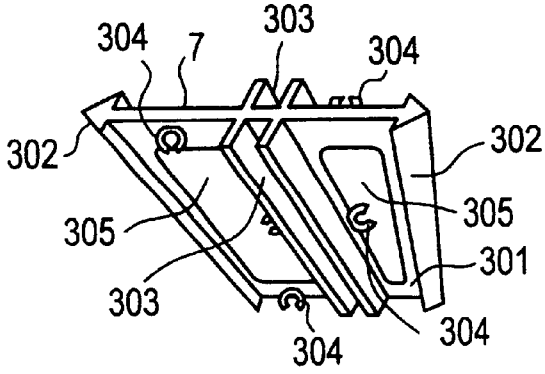
FIG. 3B is a front view of a panel connector for use in the invention.

The panel connectors are the second main component of the wall construction of the invention. FIGS. 3A, 3B and 3C illustrate a panel connector 7 for use in the invention. Panel 30 connector 7 has a body 301 having wall panel interlocking means 302 at the opposing vertical edges. Panel connector 7 has a width $W_c$. Wall panel interlocking means 302 are adapted to interlock with corresponding panel connector interlocking means 205 (shown in FIGS. 2A–2C) on the interior and exterior wall panels. On each side of body 301, between the wall panel interlocking means 302, are insulating foam panel holding means 303. As shown, insulating foam panel holding means 303 are positioned at approximately the middle of the width $W_c$ of panel connector 7. However, the positioning of insulating foam panel holding means 303 may be varied anywhere along the width of panel connector, depending on where it is desired to place the insulating foam within the wall construction. For example, insulating foam panel holding means 303 can be placed so that the insulating foam is nearly adjacent to either the interior wall panel or the exterior wall panel in the final construction.

The preferred location of the insulating foam panel holding means 303 along the width $W_c$ of panel connector 7 will depend on several factors. Those factors include structural considerations, the local climate and building codes, and any special requirements that must be met by the wall. Thermal insulating considerations favor placing the insulating foam panel holding means 303 near the exterior edge of the panel connector 7. However, to protect the insulating foam panels 12 from environmental attack such as by weathering, impact or biological agents such as termites or other insects, it is desirable that the insulating panel holding means 303 be located somewhat internally of the exterior edge of the panel connector 7, so that a cavity (such as cavities 401*b* and 401*c* in FIG. 1) that can be filled with the load bearing material is formed between the insulating foam panel 12 and the exterior wall panel 1. However, in some cases it may be desired to locate the insulating panel holding means 303 near the interior edge of panel connector 7.

It is also within the scope of the invention that the panel connectors 7 contain two or more insulating panel holding means 303 on either side of body 301. This allows a wall construction containing two or more insulating foam layers to be constructed. For example, a wall construction can be made having an insulating foam layer adjacent to the interior wall surface defined by interior wall panels 2, and a second insulating foam layer spaced apart from the interior wall surface defined by exterior wall panels 1 (see FIG. 1).

As was seen with the wall panels, interlocking means 302 preferably extend for substantially the entire vertical length of panel connector 7 to provide for maximum strength. Having full-length insulating foam panel holding interlocking means 303 makes it easier to make panel connector 7 via an extrusion process.

As shown, insulating foam panel holding means 303 for holding the foam insulating panels are integrally formed with panel connector 7. However, this is not essential. Insulating foam panel holding means 303 may be manufactured separately from panel connector 7 and affixed thereto, for example at a construction site as the wall construction is being assembled. For example, insulating foam panel holding means 303 may be designed with a hook or clip that fits over the top and/or bottom of body 301 and holds insulating foam panel holding means 303 in position. Alternatively, although less preferably, insulating foam panel holding means 303 may be affixed to panel connector 7 by gluing, nailing, screwing, lamination, or any other suitable technique.

Also shown in FIGS. 3A, 3B and 3C are optional supports 304. Supports 304 are useful, for example, for holding reinforcing means such as rebars and the like in three-dimensional space until the construction material is poured into place and hardened. As shown in FIG. 3A, support 304 may be positioned so that the reinforcing means is oriented vertically. In FIG. 3C, supports 304 allow for horizontal orientation of the reinforcing means. Note that supports 304 can have other uses besides supporting a reinforcing means. For example, supports 304 may also support piping for plumbing, drains, air vents, electrical, cable, data and phone lines, heating, ventilation air conditioning components, and the like.

Supports 304 may be made separately from panel connector 300 and subsequently attached thereto, but for reasons of cost and ease of production of panel connector 300 they are preferably integrally formed onto panel connector 300. When supports 304 are made separately from panel connector 300, the means of attachment is not critical. Similarly, the position of supports 304 may be varied as required by the parameters of the particular job. Supports 304 may also be in the form of appropriately sized and positioned cutouts from the body 301 of panel connector 7.

Figure 4:
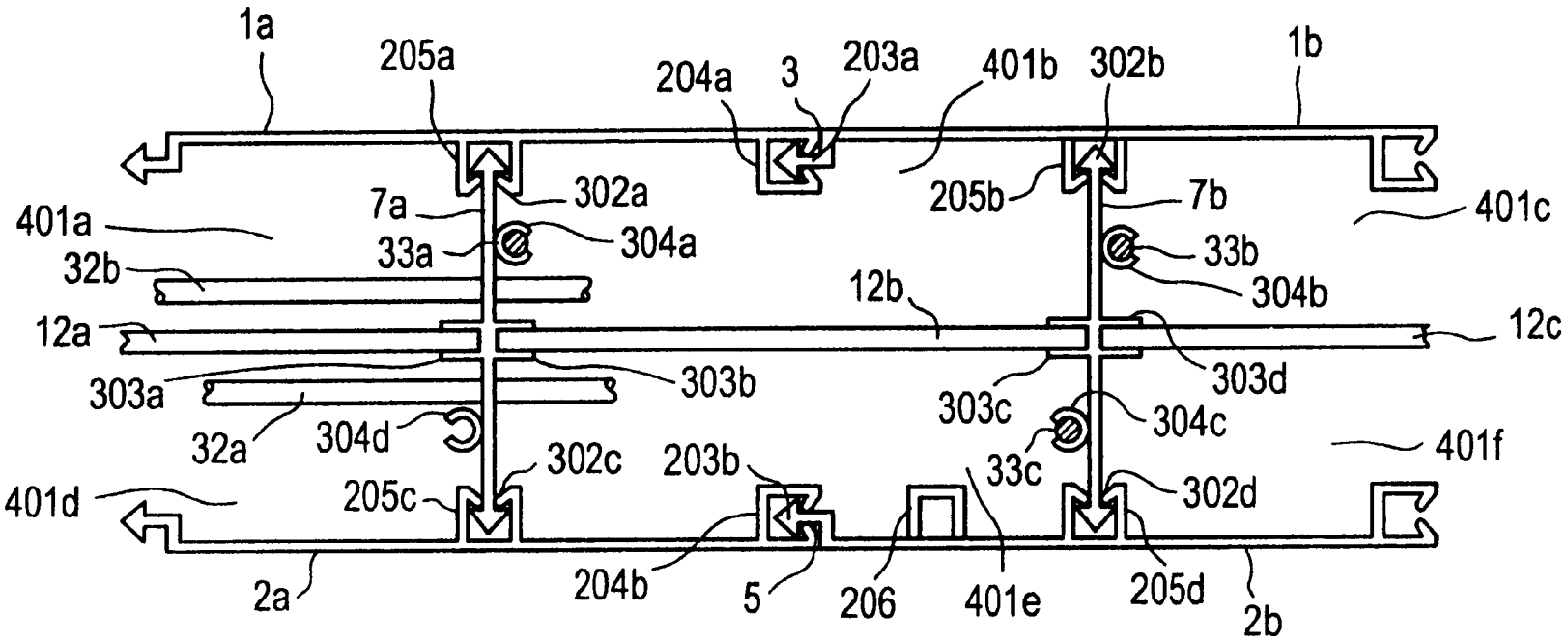
FIG. 4 is a top plan view of a portion of a form assemblage of the invention.

FIG. 4 illustrates how to assemble wall panels, panel connectors and insulating foam panels in making a form for a small section of a wall construction. Exterior wall panels 1*a* and 1*b* are interlocked at connection point 3, interlocking means 203*a* of exterior wall panel 1*b* being interlocked with reciprocal interlocking means 204*a* of exterior wall panel 1*a*. In similar manner, wall panels 2*a* and 2*b* are interlocked via interlocking means 203*b* of interior wall panel 2*b* and reciprocal interlocking means 204*b* of interior wall panel 2*a* at connection point 5. Although not shown, exterior wall panels 1*a* and 1*b* and interior wall panels 2*a* and 2*b* all can be connected in series with additional wall panels in similar fashion to extend the exterior and interior surfaces of the wall to any desired length.

In FIG. 4, panel connector 7*a* is positioned in interlocking relationship with exterior wall panel 1*a* and interior wall panel 2*a*, holding the respective wall panels at a predetermined distance from each other that corresponds to the desired overall thickness of the wall construction. Panel connector 7*a* has interlocking means 302*a* that interlockingly engages with reciprocal interlocking means 205*a* on exterior wall panel 1*a*, and a second interlocking means 302*c* that similarly engages with reciprocal interlocking means 205*c* on interior wall panel 2*a*. Panel connector 7*b* is positioned in an analogous manner between exterior wall panel 1*b* and interior wall panel 2*b*, interlocking means 302*b* and 302*d* being engaged with reciprocal interlocking means 205*b* and 205*d*, respectively, in an interlocking relationship. Insulating foam panels 12*a*, 12*b* and 12*c* are positioned roughly parallel to and between the exterior and interior wall panels, and held in such position by insulating panel holding means 303*a*, 303*b*, 303*c* and 303*d* that are affixed to panel connectors 7*a* and 7*b*.

In FIG. 4, the various exterior wall panels, interior wall panels, panel connectors and insulating foam panels define a series of cavities 401*a*, 401*b*, 401*c*, 401*d*, 401*e* and 401*f*. In the finished wall construction of this invention, these cavities are filled with load-bearing material. In FIG. 1, cavities 401*c* and 401*f* are shown filled with a load-bearing material 13*a* and 13*b*, respectively, in such a manner. Similarly, cavities 401*b* and 401*e* are shown in FIG. 1 partially filled with load-bearing material, as they might appear partway through the process of putting a pourable load-bearing material into the cavities where it is caused to harden.

As shown in FIGS. 3B and 3C, body 301 may contain holes 305. Holes 305 are a preferred feature that permit the load-bearing material to flow from one cavity across and through panel connector 7 into an adjacent cavity to form a continuous body of load-bearing material. This is illustrated in FIG. 1, in which the load-bearing material 13*c* in cavity 401*e* has flowed through a hole in panel connector 7*a* to join with the load-bearing material in the adjacent cavity to the left. Holes 305 are therefore advantageously large enough that a pour-in-place load-bearing material poured into a cavity on one side of the panel connector 7 can easily pass through the holes to fill and join with the load-bearing material in the adjacent cavity on the other side of the panel connector. As illustrated, body 301 contains only two large holes 305. However, holes 305 may be smaller than illustrated in FIGS. 3B and 3C, and a greater number of holes 305 may be present.

In the embodiment shown in FIGS. 1 and 4, the cavities exterior of the insulating foam panels 12*a–c* (i.e. cavities 401*a–c*) are approximately equal in thickness (exterior to interior) to those cavities interior of the insulating foam panels (i.e., cavities 401*d–f*). The relative thicknesses of the exterior cavities 401*a–c* and interior cavities 401*d–f* is determined by the placement of the insulating foam panels 12*a–c*, which is in turn determined by the placement of the insulating foam panel holding means 303*a–d* on the bodies of the panel connectors 7*a* and 7*b*. It is within the scope of this invention to position the insulating foam panels anywhere between the interior wall panels and the exterior wall panels, including adjacent to either the interior or exterior wall panels. For example, when the insulating foam panel is adjacent to the exterior wall panels, the corresponding cavities 401*a–c* will be reduced in thickness to zero or nearly so, and cavities 401*d–f* will be correspondingly increased in thickness. In such a case, filling cavities exterior to the insulating foam panels with load-bearing material may provide little structural benefit, and all the load-bearing material may be instead put into the cavities interior to the insulating foam panels. It is preferred, however, that the insulating foam panels be positioned between and apart from the exterior wall panels and interior wall panels, forming cavities on either side of the insulating foam panels thick enough to provide a structural benefit by filling the cavities with load-bearing material. Preferably, the cavities exterior to the insulating foam panels and interior to the insulating foam panels are all at least 1 inch (2.5 centimeters(cm))thick. Cavities exterior to the insulating foam panels are more preferably from 1 to 6 inches (2.5 to 15.2 cm) thick. Cavities interior to the insulating foam panels are more preferably from 2 to 10 inches (5.1 to 25.4 cm), and still more preferably from 3 to 8 inches (7.6 to 20.3 cm)thick.

The wall construction of this invention is made by connecting exterior wall panels, interior wall panels, wall connectors and insulating foam sections together to make a form assemblage of desired size, shape and thickness. The form assemblage is generally built onto some sub-structure such as a footing or a lower level wall or floor. Reinforcement means such as reinforcing bars advantageously extend from the substructure upward into the cavities enclosed by the form assemblage.

When reinforcing means are desired, those means are typically put into place between the interior and exterior wall panels as well. For example, FIGS. 1 and 4 show optional reinforcing bars (rebars) 32*a*, 32*b*, 33*a*, 33*b* and 33*c*, rebars 32*a–b* being oriented in a horizontal direction and rebars 33*a–c* being oriented in a vertical direction. In the embodiment shown, rebar 32*b* is shown attached to panel connector 7*a* by support 304*e*. Rebar 33*a* is attached to panel connector 7*a* by support 304*a*. Rebars 33*b* and 33*c* are attached to panel connector 7*b* by supports 304*b* and 304*c*, respectively. An addition, unused support 304*d* is shown attached to panel connector 7*a* in FIG. 4. Although rebars are illustrated in FIG. 1, other reinforcing means may be substituted for the rebars or used in place thereof. These alternative reinforcing means include straps, webs, meshes, and the like. In all cases, the use of such reinforcing means is optional. In most circumstances, local building codes will dictate whether such reinforcing means are required.

Corners can be made in several ways. A less preferred way is to cut exterior and/or interior wall panels as necessary to form a corner. Using the preferred structural foam wall panels, individual panels can be glued or cemented together to form any desired shape. Another less preferred method is to bend individual exterior and/or interior wall panels to the desired shape. Using the preferred structural foam wall panels, this can be readily accomplished by heating the wall panels to the softening temperature of the polymer from which the wall panels are made, bending the wall panel into the desired shape, and then allowing the panel to cool below the softening temperature of the polymer.

A more preferred way of forming a corner involves using one or more specially designed interlocking wall panels. FIG. 5 shows an example of a corner made with such specially designed interlocking wall panels. In FIG. 5, exterior wall panel 1*d* has the same design as exterior wall panel 2 in FIG. 2*a*. Wall panel 1*d* has reciprocal interlocking means 204*c* which is available to interlock with an adjacent wall panel (not shown) and interlocking means 203*c* which interlocks with interlocking means 205*e* on exterior wall panel 501. Wall panel 1*d* also has internal interlocking means 205*f* that interlocks with panel connector 507.

Exterior wall panel 501 also has interlocking means 203*d* that connects with reciprocal interlocking means 204*d* of adjacent exterior wall panel 1*e*. As shown, exterior wall panel 501 demonstrates an advantage achieved when the interlocking means 302 on the panel connectors 7 (see FIG. 3) are designed to fit with the reciprocal interlocking means 204 of the wall panels 2 (see FIG. 2). In that case, exterior wall panel 501 can be prepared from wall panel 2 simply by cutting wall panel 2 along the edge of interlocking means 205*e* and discarding the unneeded portion. In FIG. 5, the removed and discarded portion of a wall panel 2 is shown in dotted lines to the left of the remaining exterior wall panel 501.

Interior wall panel 502 has body 202*a*, interlocking means 203*e* and reciprocal interlocking means 204*f*. Interlocking means 203*e* is engaged with reciprocal interlocking means 504 of panel connector 507. Reciprocal interlocking means 204*f* is available to interlock with an adjacent wall panel (not shown). The length of interior wall panel 502 is advantageously selected in conjunction with that of exterior wall panel 1*d* so that interlocking means 204*c* and 204*f* are aligned.

In FIG. 5, panel connector 507 has body 301*a*. At each end of body 301*a* are interlocking means 302*e* and 302*f* for engaging with reciprocal interlocking means 205*f* of exterior wall panel 1*d* and 204*e* of exterior wall panel 1*f*. Foam insulating panel holding means 303*e* and 303*f* are located in either side of body 301*a*, and are located on body 301*a* between the interlocking means 302*e* and 302*f*. With respect to the features just described, panel connector 507 can be very similar or identical to panel connector 7 as shown in FIG. 3. However, panel connector 507 contains an additional reciprocal interlocking means 504 proximate to one end of body 301*a* and oriented at right angles proximate to interlocking means 302*f*. Reciprocal interlocking means 504 is adapted to engage interlocking means 203*e* of interior wall panel 502.

Further in FIG. 5, insulating foam panels 12*d* and 12*e* are held into place by insulating foam panel holding means 303*e* and 303*f*, respectively, of panel connector 507. Insulating foam panel 12*f* is held into place by corresponding insulating foam panel holding means on a panel connector that is not shown. Insulating foam panel 12*f* may be cut off at the point where it intersects insulating foam panel 12*e*, or may, as shown, extend all the way to exterior wall panel 1*d*. If desired, optional support 12*g* may be used to help hold insulating foam panel 12*f* into place. Optional support 12*f* may be a board or a piece of insulating foam, for example. Insulating foam panels 12*e* and 12*f* may be secured to each other to provide further structural integrity.

Other variations of the foregoing system for making corners will be apparent to those skilled in the art.

The spacing of the panel connectors is chosen primarily to provide the assembled and interlocked wall panel and panel connector system with enough strength to withstand the subsequent emplacement of load-bearing material without separating the panels and connector from one another and without unacceptable distortion. When light structures are made using the wall construction of the invention, in which no load-bearing material is used, the spacing of the panel connectors is chosen to provide the unfilled foam assemblage with the necessary structural strength. Spacing the panel connectors at intervals of from 6 to 36 inches (15.2 to 91.4 cm)is generally suitable, with a spacing of 8 to 24 inches (20.3 to 61.0 cm) being preferred, and a spacing of 10 to 24 inches (25.4 to 61.0 cm), being preferred. Using wall panels as shown in FIGS. 2A–2C, which contain only a single interlocking means 205 for connection with a panel connector, the width of the wall panel will correspond to the spacing between the panel connectors. However, wall panels can easily be made having two or more interlocking means 205 for connection with a corresponding number of panel connectors. In that case, the overall width of the wall panel can be increased. This has the effect of decreasing the number of seams that are visible on the external and internal surfaces of the completed wall construction where adjacent wall panels meet.

The cross-sectional thickness of the wall construction is determined by the width $W_c$ (FIG. 3A) of panel connectors. Accordingly, width $W_c$ is chosen so that the thickness of the wall construction is sufficient to provide the requisite structural strength. Similarly, the cross-sectional thickness of cavities formed by the wall panels, panel connectors and insulating foam panels (shown as 401*a–f* in FIG. 4) depends on the width $W_c$ of the panel connectors and the relative placement of insulating panel holding means 303*a–d* along the length of body 301 of panel connectors 7*a* and 7*b*. For constructing a basement wall for a one- or two-story single family home, the overall thickness of the wall construction is advantageously from 8 to 16 inches (20.3 to 40.6 cm), preferably from 8 to 12 inches (20.3 to 30.5 cm). For above-grade walls in a single story structure, or the walls of a top floor in a multi-story structure, the overall thickness of the wall construction is advantageously from 4 to 12 inches (10.2 to 30.5 cm).

The height of the wall construction is primarily a matter of choice for the builder. It is contemplated that the wall construction of this invention is especially useful for building basement walls and above-grade walls in approximately one-floor increments. Thus, heights from about 4 feet (1.2 meter) or higher, preferably from 7 feet (2.1 meter), more preferably from 8 feet (2.4 meter), to 15 feet (4.6 meter), preferably 12 feet (3.6 meter), more preferably to 10 feet (3.0 meter), are particularly suitable. Generally, the height of the wall panels will be the same as that of the wall construction. If greater heights are desired, this can be accomplished by erecting a second form assemblage atop a completed wall construction, and repeating the construction process until the desired height is attained.

Services may be routed through the form assemblage as desired or required. As mentioned above, conduits as shown at reference numeral 206 in FIGS. 1 and 4 may be attached to the interior or exterior wall panels in order to provide routes through which services can be routed. When such conduits are used, actual routing of most services can be done either before or after load-bearing material in put into the cavities defined by the wall panels, insulating foam panels and panel connectors. However, it is usually preferred to route certain services such as plumbing, drains and heating, ventilation and/or air conditioning ducts before the load-bearing material is put into place. Such services can be installed using usual techniques, and may be affixed to the wall panels and/or panel connectors as desired, using, for example, supports (e.g. 304*a–d*) or other suitable means. Of course, holes can be made in interior wall panels, exterior wall panels or both through which the services are delivered as needed to the interior or exterior of the wall construction.

In addition, openings for any desired windows, doors and the like can be made by cutting appropriately sized and positioned holes through the assembled panel system before adding the load-bearing material. If desired, these openings can be made on-site, or can be pre-cut into the wall panels at the point of their manufacture. The periphery of the opening is then framed out prior to pouring the load bearing material. Pre-manufactured window or door seats can, and preferably are, used for this purpose. Advantageously, the framing adheres to the load bearing material. After the wall construction is completed, the door or window casing can be attached to the framing and trimmed out as desired.

If desired, other structural or functional components may be added to the form assemblage, such as, for example, a moisture or vapor barrier sheet or film. For convenience, the moisture or vapor barrier film may be attached to the inside surface of either or both of the interior and exterior wall panels or to either or both sides of the insulating foam panels prior to assembling the form assemblage. Other structural or functional components include, for example, protruding bolts or other fasteners for attachment of a roof, eaves, ceiling, trusses, and the like; cut-outs for joists, rafters and the like, protruding reinforcing rods or bars, and the like.

Once the form assemblage is completed, any required openings are framed out and necessary services are routed, a load-bearing material can be put into place. In preferred embodiments, the load-bearing material is poured into place and subsequently hardened. If the wall is thick or tall, or if a particularly dense load-bearing material is used, it may be desirable to pour the load-bearing material into the frame in discrete portions, typically 6 to 36 inches (15.2 to 91.4 cm) in depth, and allowing each of those portions to harden before pouring in the succeeding portion. This minimizes distortion of the interior and interior wall panels due to the weight of the construction material.

If desired, external supports may be used to brace the exterior wall panels, interior wall panels or both while the load-bearing material is put into place.

The exterior and interior wall panels can be made with any material that has sufficient rigidity to withstand the stresses placed upon it during the construction of the wall without breaking or becoming significantly distorted. Thus, the wall panels may be made of a wide variety of materials that are sufficiently rigid. These include, for example, gypsum wallboard (drywall), plywood and unexpanded plastics such as polyvinyl chloride (PVC), polypropylene, polyethylene terephthalate (PET), polycarbonate (PC), polycarbonateacrylonitrile/butadiene/styrene polymer (PC-ABS) blends, high density polyethylene, polyacrylates such as polymethyl methacrylate, rigid polyurethane, rigid polyisocyanurate and fiberglass or other composites. However, the exterior and especially the interior wall panels advantageously are made of a cellular thermoplastic or thermosetting material commonly known as a "structural foam".

A structural foam is a cellular material made from a rigid organic polymer having a density as described below. The use of a structural foam has several advantages. First, it can be readily extruded or molded into a variety of configurations. Second, a structural foam sheet of a given weight is thicker than a sheet of nonexpanded polymeric sheet of same overall weight. The increased thickness increases its rigidity per unit weight. In the case of an interior wall panel that will ultimately form the exposed interior surface of the wall construction a structural foam exhibits some improved insulating capability relative to a nonexpanded polymeric sheet. As a result, the wall tends to feel somewhat warmer to the touch when the interior wall panel is made from a structural foam.

The density of the structural foam and its material of construction are selected so it substantially maintains its shape and dimensions under the stresses to which it is subjected during the construction of the wall. Suitable polymers from which the structural foam can be made include those identified above as unexpanded plastics. Reinforcing materials such as glass, polymeric or carbon fibers, glass or ceramic flakes or inorganic fillers may be incorporated into the structural foam if desired. The structural foam advantageously has a density of from 15 pcf (240 kilogram/cubic meter (kg/m$^3$)), preferably from 20 pcf (320 kg/m$^3$), more preferably 25 pounds per cubic foot (pcf) (400 kg/m$^3$) up to 50 pcf (801 kg/m$^3$), preferably 45 pcf (721 kg/m$^3$), more preferably 40 pcf (641kg/m$^3$). A structural foam wall panel is advantageously from about 1, preferably about 2 mm in thickness, up to about 25, preferably about 15, more preferably about 10 mm in thickness.

As the exterior and interior wall panels often will become a permanent fixture to the wall construction, it is preferred to adapt the external surfaces of the wall panels to provide aesthetic or functional features. For example, the external surface of the exterior wall panel may be textured to provide the look of more conventional exterior building materials, such as with a brick pattern, a siding pattern, a stucco pattern, or the like. The external surface of the interior wall panel may be textured as well, such as with a simulated wood grain pattern, a geometric pattern, a brick pattern, or any other aesthetically desirable surface pattern. In addition, the interior or exterior wall panels may be dyed or otherwise colored to any predetermined color. If desired, a veneer or other decorative external show surface may be laminated or otherwise adhered to the interior wall panel.

Similarly, the panel connectors may be made from a wide variety of materials, with thermoplastic or thermosetting resins being preferred materials of construction. It is particularly preferred that the panel connectors be made of a thermoplastic or thermosetting structural foam as described with respect to the wall panels.

The preferred structural foam wall panel and panel connectors can be made by any suitable process, such as by injection molding or extrusion. An extrusion process tends to be low cost, and is advantageous from that standpoint. However, some shapes and configurations are difficult to produce in an extrusion process, and must be added to the wall panels in a subsequent operation.

Any load-bearing material may be used that will provide adequate strength and rigidity. In simpler or less expensive wall constructions, the load-bearing material can be, for instance, wood, stone, dirt, sand, metal, and the like. These are advantageously used in a particulate form so they can be readily poured into the form assemblage as a loose fill. However, this invention is particularly adapted for use with a load-bearing material that is poured into place after the system of wall panels, insulating foam panels and panel connectors is assembled, and then hardened. Accordingly, any of the many forms of cement such as Portland cement, aluminous cement and hydraulic cements are suitable, as are hardenable clays such as adobe, mortar, and hardenable mixtures of clay and cement. It is generally preferred for reasons of cost and properties to use concrete, which is an aggregate of a material such as gravel, pebble, sand, broken stone, slag, or cinders, in a hardenable matrix, usually mortar or a form of cement such as Portland, aluminous or hydraulic cement. Generally, any concrete or aggregate that is useful in preparing load-bearing building walls is suitable for use with this invention.

In the preferred wall construction made using a hardenable load-bearing material, the exterior and interior wall panels are advantageously permanently bound to the wall construction by the panel connectors and by adhesion to the hardened load-bearing material. Preferably, the load-bearing material also adheres to the insulating foam sections so that the overall wall structure has physical integrity across its thickness from exterior to interior. The panel connectors may in some cases contribute to this physical integrity, although it is anticipated that the main cross-sectional (from exterior to interior) strength of the wall construction is created by the adhesion of the load-bearing material to the exterior and interior wall panels and the insulating foam panels. Of course, this can be supplemented if desired using any suitable means. For example, the insulating foam panels and internal surfaces of the wall panels may contain protrusions or other irregularities that become embedded in the hardened load bearing material, thereby providing a mechanical coupling to supplement the adhesion.

The insulating foam panels can be made from any cellular insulating material that is rigid enough to substantially maintain its shape during the construction of the wall. Preferably, the insulating foam panel is a cellular polymeric foam. It may be made from a thermosetting or thermoplastic polymer. Suitable polymers include polyethylene (including low density polyethylene (LDPE), linear low density polyethylene (LLDPE), high density polyethylene (HDPE) and substantially linear ethylene interpolymers), polypropylene, polyurethane, polyisocyanurate, ethylene-vinyl acetate copolymers, polyvinyl chloride, phenol-formaldehyde resins, ethylene-styrene interpolymers and polyvinyl aromatic resins, especially polystyrene. Blends of any two or more of the foregoing or blends of any of the foregoing with another polymer or resin are suitable. Polystyrene, rigid polyurethane, polyisocyanurate and phenolic resins are preferred, with polystyrene and polyisocyanurate being especially preferred.

The insulating foam panel is preferably a closed-cell foam having at least 60%, preferably at least 80%, more preferably at least 90% closed cells. The insulating foam panel advantageously has a density from 0.8 pcf (12.8 kg/m$^3$), preferably from 1 pcf (16.0 Kg/m$^3$), more preferably from 1.2 pcf (19.2 kg/m$^3$) up to 6 pcf (96.1 kg/m$^3$), preferably up to 3.0 pcf (48.0 kg/m$^3$), more preferably up to 2.0 pcf (32.0 kg/m$^3$). It may have a skin on its major surfaces, which can act as a moisture barrier.

The thickness of the insulating foam panel can vary depending on the amount of insulating effect that is desired. Typically, the insulating foam panel will be from 0.5 inch (1.3 cm), preferably from 1 inch (2.5 cm), to 6 inches (15.2 cm), preferably to 2 inches (5.1 cm) thick. The thickness of the insulating foam layer will often be determined by local insulation needs and local building codes. In most cases, using a thicker insulating foam layer will improve the thermal insulating properties of the wall construction.

Many insulating foam panels are made using a volatile blowing agent that escapes from the foam over time and is replaced by air. During this aging process, the foam often experiences dimensional changes due to changes in internal cell gas pressures as the blowing agent escapes and air permeates into the cells. After this process is largely completed, the foam dimensions stabilize. An advantage of this invention is that it permits the use of insulating foam panels that are previously manufactured and aged, and are therefore dimensionally stable.

As discussed before, the invention is particularly suitable for use with a load-bearing material that fills cavities created in the form assemblage between the interior and exterior wall panels, the insulating foam panels and the panel connectors. However, the form assemblage of this invention can be adapted for other uses.

An alternative form assemblage of this invention includes interlocked interior and exterior wall panels as described before, which are interlocked with and separated by panel connectors. In this alternative form assemblage, the insulating foam panel holding means described before may be omitted from the panel connectors. A form assemblage of this type is adapted for use in light-duty applications such as garages, tool sheds and storage buildings. The space between the interior wall surface and the exterior wall surface may be left empty, or filled with a load-bearing material as discussed before. Alternatively, a thermal insulating foam material may be put into the space between the interior and exterior wall surfaces.

A second alternative form assemblage retains the insulating foam panel holding means, but the width $W_c$ of the panel connectors is such that the insulating foam panels substantially fill the space between the interior wall surface and the exterior wall surface. Again, this alternative foam assemblage is particularly suitable for light-duty applications as discussed above.

The form assemblage of this invention is easily adapted for manufacturing pre-cast wall panels that can be transported to a construction site and connected together to construct a completed wall. This provides the advantage of reducing the amount of labor required at the construction site.

One advantage of using structural foam interior wall panels is that the structural foam can form the final, exposed "show" surface of the interior wall. Thus, it is not necessary to construct an additional interior show surface. As discussed above, seams will normally appear at the conjunction of adjacent interior wall panels and adjacent exterior wall panels. If desired, the seams can be filled with a variety of filler materials such as putties, wood fillers, plastic fillers and the like. For preferred structural foam wall panels, plastisol formulations, which are typically solutions of synthetic resins in a suitable solvent, are especially useful for filling in seams to provide a smooth finish. If desired, the interior and exterior wall panels can be painted, stained, papered or otherwise decorated to provide any desired final appearance.

What is claimed is:

1. A wall construction comprising (A) a form assemblage having (1) an interior wall surface comprising a plurality of interlocked interior wall panels, each panel having a first interlocking means on at least one panel edge and a second interlocking means on at least one panel edge, the first and second interlocking means being on opposing panel edges, the first interlocking means of one interior wall panel interlocking with the second interlocking means of an adjacent interior wall panel, said interior wall panels having at least one first panel connector interlocking means located on an internal surface thereof;

(2) an exterior wall surface spaced apart from said interior wall surface, said exterior wall surface comprising a plurality of interlocked exterior wall panels, each panel having a third interlocking means on at least one panel edge and a fourth interlocking means on at least one panel edge, the third and fourth interlocking means being on opposing panel edges, the first interlocking means of one exterior wall panel interlocking with the second interlocking means of an adjacent exterior wall panel, said exterior wall panels having at least one second panel connector interlocking means located on an internal surface thereof;

(3) a plurality of panel connectors, each panel connector having a body with interior wall panel interlocking means on one end interlocked with a first panel connector interlocking means of an interior wall panel and exterior wall panel interlocking means on an opposing end interlocked with a second panel connector interlocking means of an exterior wall panel, wherein said panel further contain at least one insulating foam panel holding means located on said body between said interior wall panel interlocking means and said exterior wall panel interlocking means; and (4) a plurality of insulating foam panels located between and substantially parallel to said interior wall surface and said exterior wall surface and between each consecutive pair of panel connectors, said insulating foam panels being held in position by said foam insulating panel holding means on said consecutive panel connectors;

wherein said foam assemblage forms a plurality of cavities each bound by an insulating foam panel, the adjacent panel connectors which hold said insulating foam panel in place, and at least one of said interior wall surface or exterior wall surface, and (B) a load-bearing material that fills said cavities.

2. The wall construction of claim 1 wherein said load-bearing material is hardenable.

3. The wall construction of claim 1, wherein at least one of (a) said interior wall panels, (b) said exterior wall panels, and (c) said panel connectors, are made of a structural foam.

4. The wall construction of claim 1 wherein said insulating foam panels are disposed proximate to at least one of said interior wall surface and said exterior wall surface.

5. The wall construction of claim 2, wherein said hardenable load-bearing material comprises concrete.

6. The wall construction of claim 3, wherein said interior and exterior wall panels comprise a polyvinyl chloride structural foam.

7. The wall construction of claim 1, wherein said interior and exterior wall panels comprise a fiber-reinforced tructural foam.

8. A method for making a wall construction comprising (a) interlocking a plurality of interior wall panels to form an interior wall surface, each panel having a first interlocking means on at least one panel edge and a second interlocking means on at least one panel edge, the first and second interlocking means being on opposing panel edges, the first interlocking means of one interior wall panel interlocking with the second interlocking means of an adjacent interior wall panel, said interior wall panels having at least one first panel connector interlocking means located on an internal surface thereof;

(b) interlocking a plurality of exterior wall panels to form an exterior wall surface, each panel having a third interlocking means on at least one panel edge and a fourth interlocking means on at least one panel edge, the third and fourth interlocking means being on opposing panel edges, the third interlocking means of one exterior wall panel interlocking with the fourth interlocking means of an adjacent exterior wall panel, said exterior wall panels having at least one second panel connector interlocking means located on an internal surface thereof;

(c) interlocking the interior wall surface and the exterior wall surface by way of a plurality of panel connectors, each panel connector having a body with interior wall panel interlocking means on one end interlocked with a first panel connector interlocking means of an interior wall panel and exterior wall panel interlocking means on an opposing end interlocked with a second panel connector interlocking means of an exterior wall panel, wherein said panel connectors further contain least one insulating foam panel holding means located on said body between said interior wall panel interlocking means and said exterior wall panel interlocking means; and (d) mounting a plurality of insulating foam panels between and substantially parallel to said interior wall surface and said exterior wall surface and between each adjacent pair of panel connectors by means of said foam insulating panel holding means on said adjacent panel connectors, thereby forming a plurality of cavities each bounded by an insulating foam panel, the adjacent panel connectors which hold said insulating foam panel in place, and at least one of said interior wall surface or exterior wall surface, and (e) filling said cavities with a load-bearing material.

9. The method of claim 8, wherein said load-bearing material is hardenable.

10. The method of claim 8, wherein at least one of (a) said interior wall panels, (b) said exterior wall panels , and (c) said panel connectors, are made of a structural foam.

11. The method of claim 8, wherein said insulating foam panels are disposed proximate to at least one of said interior wall surface and said exterior wall surface.

12. The method of claim 9, wherein said hardenable load-bearing material comprises concrete.

13. The method of claim 10, wherein said interior and exterior wall panels comprise a polyvinyl chloride structural foam.

14. The method of claim 8, wherein said interior and exterior wall panels comprise a fiber-reinforced structural foam.

15. A form assemblage comprising (a) an interior wall surface comprised of a plurality of interlocked interior wall panels, each panel having a first interlocking means on at least one panel edge and a second interlocking means on at least one panel edge, the first and second interlocking means being on opposing panel edges, the first interlocking means of one interior wall panel interlocking with the second interlocking means of an adjacent interior wall panel, said interior wall panels having at least one first panel connector interlocking means located on an internal surface thereof;

(b) an exterior wall surface spaced apart from said interior wall surface, said exterior wall surface comprising a plurality of interlocked exterior wall panels, each panel having a third interlocking means on at least one panel edge and a fourth interlocking means on at least one panel edge, the third and fourth interlocking means being on opposing panel edges, the first interlocking means of one exterior wall panel interlocking with the second interlocking means of an adjacent exterior wall panel, said exterior wall panels having at least one second panel connector interlocking means located on an internal surface thereof; and (c) a plurality of panel connectors, each panel connector having a body with interior wall panel interlocking means on one end interlocked with a first panel connector interlocking means of an interior wall panel and exterior wall panel interlocking means on an opposing end interlocked with a second panel connector interlocking means of an exterior wall panel, wherein said panel connectors further contain at least one insulating foam panel holding means located on said body between said interior wall panel interlocking means and said exterior wall panel interlocking means.

16. The wall construction of claim 1, wherein at least one of the interior wall surface and the exterior wall surface comprises a sheet of thermoplastic or thermosetting structural foam.

17. The wall construction of claim 16, wherein the foam has a density of from 25 to 45 pounds per cubic foot (400 to 721 kilograms per cubic meter).

18. The wall construction of claim 16, wherein an external, exposed surface of at least one of the interior wall surface and the exterior wall surface is embossed, colored or laminated to provide an aesthetic show surface.

* * * * *